US008899689B2

(12) United States Patent
Killion

(10) Patent No.: US 8,899,689 B2
(45) Date of Patent: Dec. 2, 2014

(54) AUTOMATIC CUT-TRANSITION MILLING MACHINE AND METHOD

(75) Inventor: Daniel H. Killion, Blaine, MN (US)

(73) Assignee: Caterpillar Paving Products Inc., Minneapolis, MN (US)

( * ) Notice: Subject to any disclaimer, the term of this patent is extended or adjusted under 35 U.S.C. 154(b) by 126 days.

(21) Appl. No.: 13/332,630

(22) Filed: Dec. 21, 2011

(65) Prior Publication Data

US 2013/0162003 A1 Jun. 27, 2013

(51) Int. Cl.
*E01C 23/088* (2006.01)
*E01C 23/12* (2006.01)
*E01C 19/00* (2006.01)

(52) U.S. Cl.
CPC ..... *E01C 23/088* (2013.01); *E01C 19/004* (2013.01); *E01C 23/127* (2013.01)
USPC ..... 299/1.5; 299/39.6

(58) Field of Classification Search
USPC ..... 299/1.05, 1.4, 1.5, 36.1, 39.4, 39.6; 404/84.1; 99/1.05, 1.4, 1.5, 36.1, 39.4, 99/39.6
See application file for complete search history.

(56) References Cited

U.S. PATENT DOCUMENTS 3,674,094 A * 7/1972 Kuntz ..... 172/4.5
4,103,973 A 8/1978 Cutler
4,139,318 A * 2/1979 Jakob et al. ..... 404/90
7,942,604 B2 5/2011 Willis et al.
7,946,788 B2 * 5/2011 Jurasz et al. ..... 404/84.8
2007/0150148 A1 * 6/2007 Rasmussen ..... 701/50
2008/0152428 A1 6/2008 Berning et al.
2008/0153402 A1 * 6/2008 Arcona et al. ..... 451/352
2009/0016818 A1 1/2009 Hall et al.
2009/0035064 A1 2/2009 Holl et al.
2009/0311045 A1 12/2009 Jurasz et al.
2011/0206456 A1 8/2011 Jurasz et al.

FOREIGN PATENT DOCUMENTS

DE 4017107 A1 * 3/1991

OTHER PUBLICATIONS

English translation of DE4017107A1.*

* cited by examiner

*Primary Examiner* — David Bagnell
*Assistant Examiner* — Michael Goodwin
(74) *Attorney, Agent, or Firm* — Miller, Matthias & Hull; Joseph R. Reed

(57) ABSTRACT

A milling machine is provided including: a frame; a plurality of ground engaging units; a plurality of vertically adjustable legs, the plurality of vertically adjustable legs comprising a front leg and a rear leg; a rotatable mill configured to mill a surface; a user interface configured to receive a milling grade depth and a cut-transition factor; a speed sensor configured to provide a ground speed of the milling machine; a vertical position sensor; and a controller coupled to the speed sensor, the vertical position sensor, and the user interface, the controller configured to lower a height of the rotatable mill to the milling grade depth by incrementally adjusting a length of at least one of the plurality of vertically adjustable legs according to the cut-transition factor, the speed sensor, and the vertical position sensor.

20 Claims, 5 Drawing Sheets

AUTOMATIC CUT-TRANSITION MILLING MACHINE AND METHOD

TECHNICAL FIELD

Embodiments of the present disclosure pertain to machines for the treatment of roadway surfaces, and more particularly to a road planer for roadway surfacing operations

BACKGROUND

Road milling machines, also known as cold planers, may be configured to remove, mix, or reclaim material from the surface of bituminous, concrete, or asphalt roadways and other surfaces using a rotatable planing tool mounted on a frame. The frame may be mounted on a plurality of tracks or wheels which support and transport the machine along the roadway surface.

Typically, cold planers may also include a plurality of lifting members positioned near the front and rear of the frame. The lifting members may be adjusted between extended and retracted positions to control the depth and shape of a cut by raising or lowering the frame and rotatable planing tool.

A road surface is often used after the road has been milled by a milling machine. Without a smooth transition between the milled and non-milled surfaces damage or discomfort may occur for cars that travel along the road. Conventional milling machines require operators to manually adjust the level settings while the machine propels forward to create a smoother transition. However, this often results in inconsistent transitions and also takes the operator's attention away from other tasks while focusing on making the transition cuts.

U.S. Publication No. US2008/0152428 A1, published Jun. 26, 2008, describes a road milling machine and method for measuring the milling depth. However, it still suffers from the problems mentioned above.

SUMMARY

According to aspects disclosed herein, a milling machine and method for milling are provided to automatically control a cut-transition to or from a desired cutting depth.

According to an aspect of an embodiment herein, a milling machine is disclosed. The milling machine includes: a frame; a plurality of ground engaging units; a plurality of vertically adjustable legs, each of the plurality of vertically adjustable legs connecting one of the plurality of ground engaging units to the frame, the plurality of vertically adjustable legs comprising a front leg and a rear leg; a rotatable mill configured to mill a surface; a user interface configured to receive a milling grade depth and a cut-transition factor; a speed sensor configured to provide a ground speed of the milling machine; a vertical position sensor; and a controller coupled to the speed sensor, the vertical position sensor, and the user interface, the controller configured to lower a height of the rotatable mill to the milling grade depth by incrementally adjusting a length of at least one of the plurality of vertically adjustable legs according to the cut-transition factor, the speed sensor, and the vertical position sensor.

According to an aspect of an embodiment herein, a method for milling is disclosed. The method includes: receiving a milling grade depth and a cut-transition factor; monitoring a ground speed; and automatically adjusting a current milling depth of a milling machine according to the milling grade depth, the cut-transition factor, and the ground speed.

According to an aspect of another embodiment herein, a method for milling is disclosed. The method includes: receiving a target milling grade depth and a cut-transition factor; generating a transition distance according to the cut-transition factor; generating a cut-transition map indicating intermediate milling depths and respective horizontal positions; monitoring a ground speed; generating a current horizontal position according to the ground speed; and adjusting a current milling grade depth according to the cut-transition map and the current horizontal position.

DETAILED DESCRIPTION

Exemplary embodiments of the present invention are presented herein with reference to the accompanying drawings. Herein, like numerals designate like parts throughout.

Figure 2:
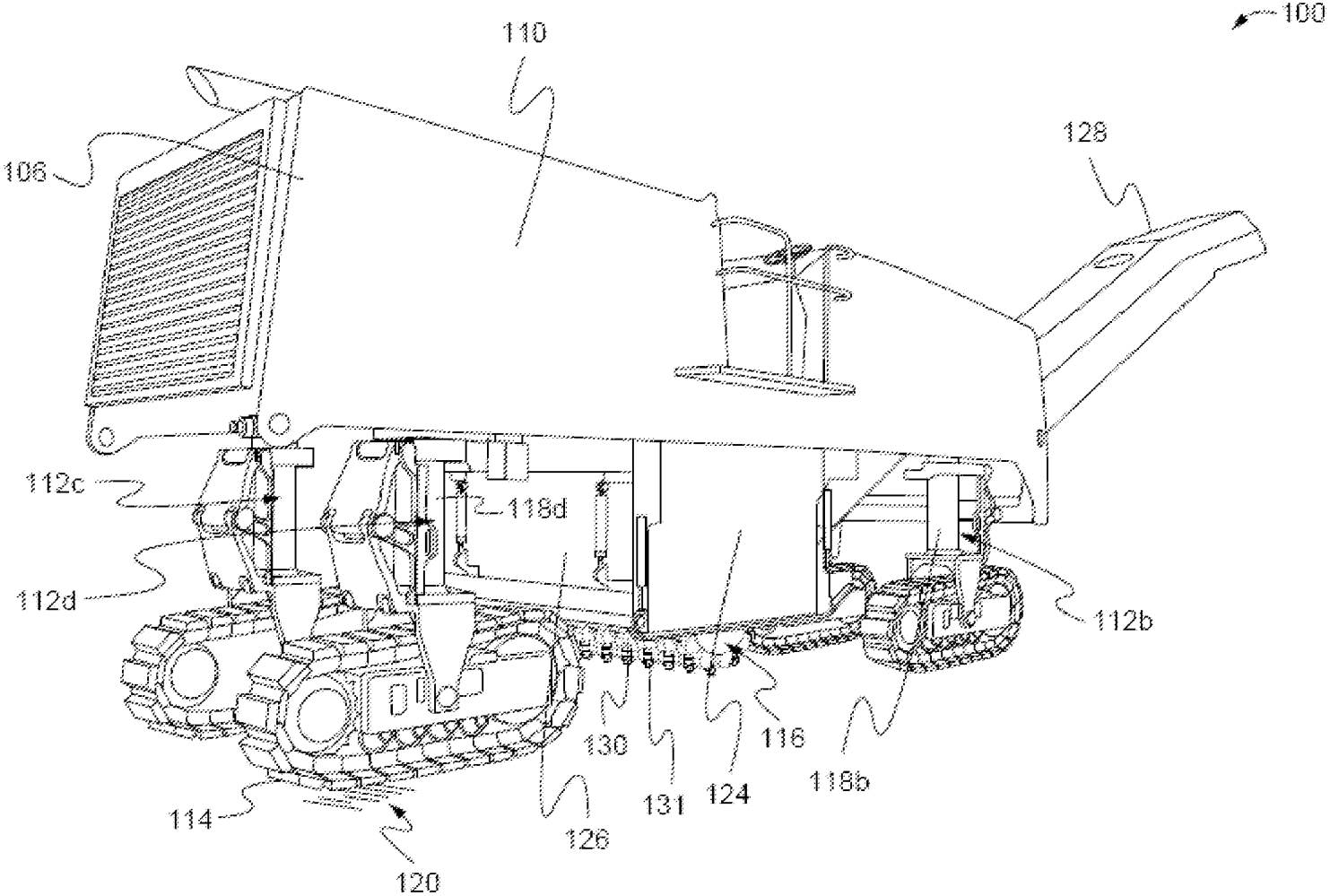
FIG. 2 is another perspective view of the exemplary machine of FIG. 1.
Figure 3:
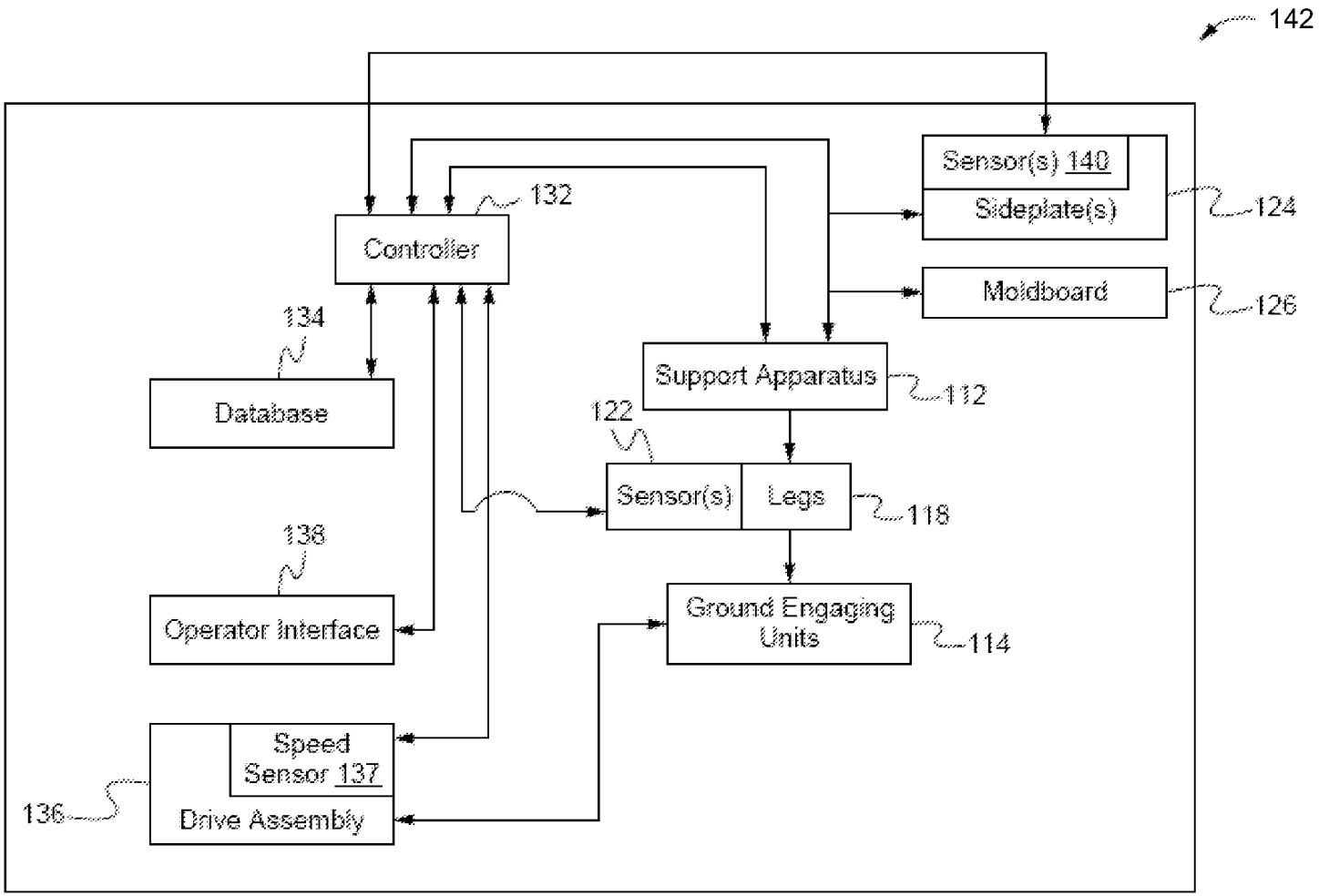
FIG. 3 is a general schematic view of a portion of an exemplary embodiment of machine in accordance with the teachings of this disclosure.

Machines may be configured to perform work operations at job sites. Examples of machines may include cold planers, on- and off-highway vehicles, construction equipment, and earth-moving equipment. While the teachings of this disclosure are not limited to a particular type of machine, an exemplary machine 100, a cold planer, is shown in FIGS. 1-3 and discussed below to illustrate the teachings of this disclosure.

The exemplary machine 100, (e.g., a milling machine or a cold planer) may be configured to remove, mix, or reclaim material from the surface of bituminous, concrete, or asphalt roadways and other surfaces. The cold planer 100 may include a frame 102, a support apparatus 112, a plurality of ground engaging units 114 and a tool 116 (e.g., rotatable mill 116). The frame 102 may include a front end 104, a rear end 106, a first side 108 and a second side 110.

Figure 1:
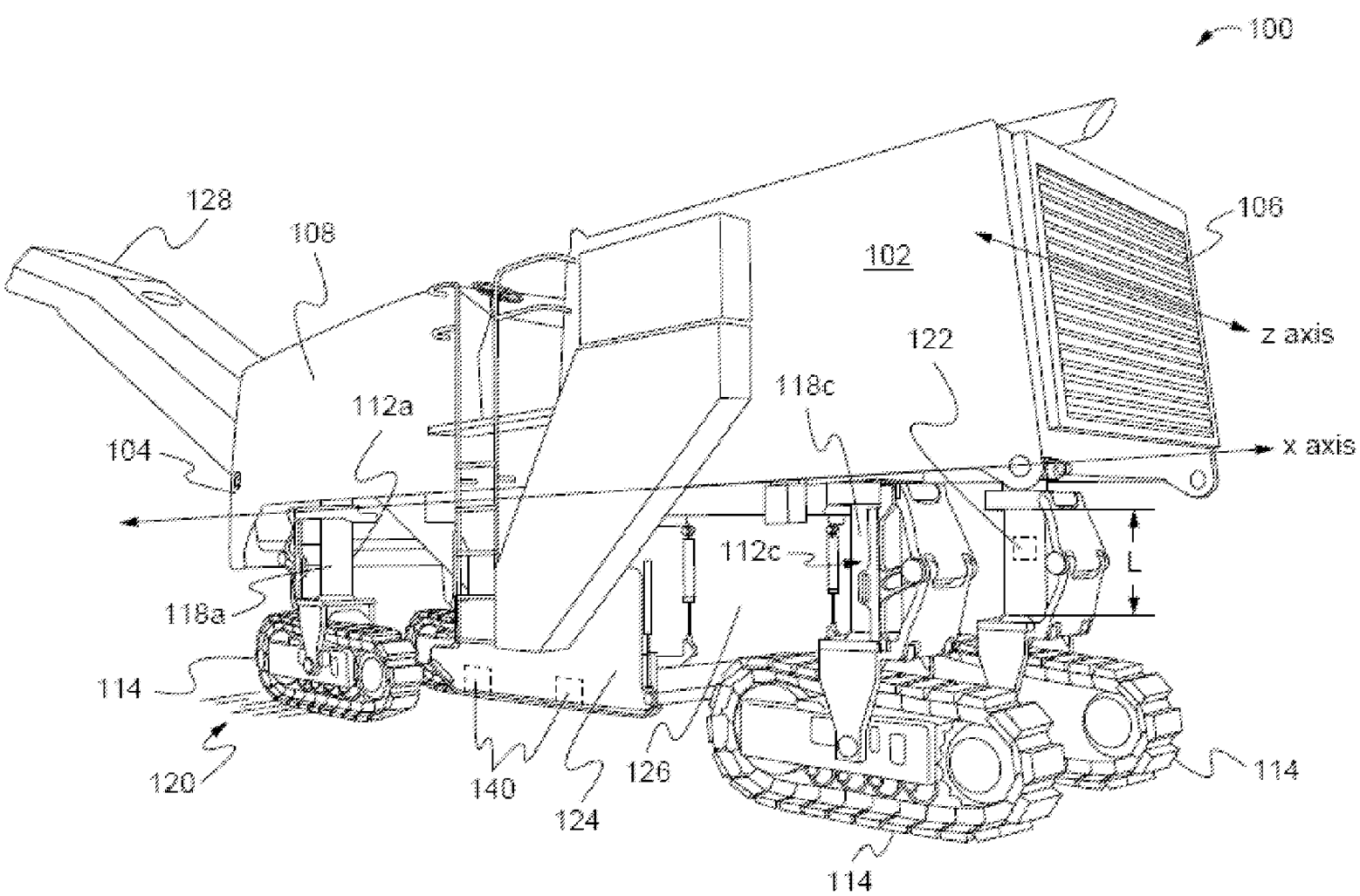
FIG. 1 is a perspective view of an exemplary machine in accordance with the teachings of this disclosure.

As shown in FIG. 1, the machine 100 may include a plurality of support apparatus 112. Some of the plurality of support apparatuses (referred to herein as the "front support apparatus" 112*a*) may be disposed proximal to the front end 104 of the frame 102, and some of the plurality of support apparatuses (referred to herein as the "rear support apparatus" 112*b*) may be disposed proximal to the rear end 106 of the cold planer 100. As illustrated in FIGS. 1-2, there are two front support apparatuses 112*a* disposed on opposite sides of the front end 104 of the frame 102, and two rear support apparatuses 112*b* disposed on opposite sides of the rear end 106 of the frame 102.

The support apparatus 112 may be configured to support frame 102 on a surface 120. Each support apparatus 112 may include a leg 118. A leg position sensor 122 may be disposed on, inside, or adjacent to each leg 118. Each leg position sensor 122 may provide to one or more controllers 132 (see FIG. 3) of the cold planer 100 information including, but not limited to, the length L of the leg 118 or the amount of extension or the amount of retraction of the leg 118. In one embodiment, the length L of the leg may be determined by the controller 132 based on a known leg length and the amount of extension or refraction of the leg 118 from that known leg length. Other ways of determining leg length are also contemplated. Other sensors may be disposed on the frame 102 for sensing other parameters of the machine 100.

In the embodiment illustrated in FIGS. 1-2 there are two front legs 118*a*, 118*b*, and two rear legs 118*c*, 118*d*. The two front legs 118*a*, 118*b* may be disposed on opposite sides of the front end 104 of the frame 102. The two rear legs 118*c*, 118*d* may be disposed on opposite sides of the rear end 106 of the frame 102.

Ground engaging units 114 may be configured to perform the function of transporting the cold planer 100 across a surface 120. Ground engaging units 114 may include tracks, wheels, and/or other known traction devices suitable for use on mobile machines. At least one ground engaging unit 114 may be powered by a machine drive assembly 136 (see FIG. 3) for forward and rearward movement of cold planer 100. An example of a drive assembly 136 may include an internal combustion engine or a hydraulic motor. It is further contemplated that ground engaging units 114 may be coupled to frame 102 by the legs 118.

Legs 118 may be vertically adjustable. As such, the legs 118 may be extended (lengthened) to cause upward movement of the frame 102 with respect to the surface 120 on which the cold planer 100 is disposed and may be retracted (shortened) to cause downward movement of frame 102 with respect to surface 120.

In one embodiment, the legs 118 may be columns that include telescoping portions (not shown), such as, for example, overlapping cylindrical segments adapted to slide inward (retract) or outward (extend) with respect to each other. The inward and outward sliding of the overlapping cylindrical segments may raise and lower frame 102, and their movement may be actuated by e.g., hydraulic pressure.

Frame 102 may also include one or more structural load carrying members adapted to support and/or protect components of cold planer 100. The frame 102 may include one or more sideplates 124 mounted on the sides of the frame 102. In the exemplary embodiment illustrated in FIGS. 1-2, the frame 102 includes two sideplates 124, each moveable in a generally vertical direction between a raised position and a lowered position. One of the plurality of sideplates 124 is attached to a first side 106 of the frame 102, and the other sideplate 124 is attached to a second side 108 of the frame 102.

FIG. 1 illustrates the sideplate 124 on the first side 108 of the frame 102 in the lowered position. FIG. 2 illustrates the other sideplate 124 on the second side 110 of the frame in the raised position. One or more sideplate sensors 140 (e.g., vertical position sensors 140) may be disposed on each sideplate 124. Each sideplate sensor 140 may provide vertical position information with regard to the sideplates and/or information as to whether the sideplate is in contact with the surface 120 to controllers 132(*a-b*) of the cold planer 100.

The frame 102 may also include a moldboard 126, moveable with respect to the rest of the frame 102 in a generally vertical direction between a raised and lowered position. FIG. 1 illustrates the moldboard 126 in a lowered position. FIG. 2 illustrates a moldboard 126 in a raised position.

The tool 116 may be supported on or within frame 102. In the embodiment illustrated in FIG. 1, the machine 100 also includes a conveyor 128. The tool 116 may include a rotatable planing tool, such as, for example, a rotatable drum 130 (e.g., cylinder or mill). The drum 130 may include a plurality of replaceable bits 131 mounted thereon and may be lowered to engage the surface 120. Upon engagement, the drum 130 may rotate and the bits 131 may cut and remove material from the surface 120. The removed material may enter the conveyor 128 which may transfer the removed material into another vehicle (e.g., a dump truck which is not shown), or the like, for transport off-site.

The height and geometry of the tool 116, in the exemplary embodiment the drum 130, relative to the surface 120 may determine the shape and depth of cut made in the surface 120 and may affect the amount of material removed from the surface 120. In order to control the shape and depth of a cut in the surface, the grade of the drum 130 may be adjusted such that the drum 130 may be vertically moved away from, towards, or into surface 120 by extending or retracting the legs 118 of the machine 100. The slope of the drum (and the cut that it makes) may also be adjusted by raising or lowering the legs 118 on one side of the machine 100 to a different height than the legs 118 on the opposite side of the machine 100.

A hydraulic system (not shown) may be configured to direct pressurized hydraulic fluid to cause upward or downward movement of legs 118. The hydraulic system may include a hydraulic circuit for selectively supplying the pressurized hydraulic fluid to different areas of hydraulic system and hydraulic cylinders to convert the hydraulic pressure into mechanical motion for actuating legs 118.

As illustrated in FIG. 3, control of the cold planer 100 may be managed by a grade and slope system 142. The grade and slope system 142 may include one or more embedded or integrated controller(s) 132, a database 134, an operator interface 138 (e.g., user interface 138), a drive assembly 136, a speed sensor 137, a support apparatus 112, legs 118, a leg position sensor 122 (or sensors 122, e.g., cut depth sensors 122), ground engaging units 114, a sideplate 124, a sideplate sensor 140 (or sensors 140), and a moldboard 126.

The controller(s) 132 may take the form of one or more processors, microprocessors, microcontrollers, electronic control modules (ECMs), electronic control units (ECUs), or any other suitable means for electronically controlling functionality of the cold planer 100.

The controller(s) 132 may be configured to operate according to an algorithm (e.g., a predetermined algorithm) or a set of instructions for controlling the cold planer 100 based on various operating conditions of the cold planer 100. Such an algorithm or set of instructions may be read into an on-board memory of the controller(s) 132, or preprogrammed onto a storage medium or memory accessible by the controller(s) 132, for example, in the form of a floppy disk, hard drive, optical medium, random access memory (RAM), read-only memory (ROM), or any other suitable computer readable storage medium commonly used in the art (each referred to as a "database").

The controller(s) 132 may be in electrical communication or connected to the drive assembly 136, or the like, and various other components, systems or sub systems (not pictured) of the cold planer 100. The drive assembly 136 may comprise an engine or hydraulic motor among other elements.

The controller 132 may receive data pertaining to the current operating parameters of the cold planer 100 from sensors and the like. In response to such input, the controller 132 may perform various determinations and transmit output signals corresponding to the results of such determinations or corresponding to actions that need to be performed. A speed sensor 137 may be coupled to the motor and may provide data such as measured ground speed to the controllers 132. In response to receipt of the average measured ground speed, the controller 132 may use this input to estimate the distance traveled by the machine 100.

The controller(s) 132 may include a plurality of input interfaces for receiving information and command signals from various switches and sensors and other controllers associated with the cold planer 100 and a plurality of output interfaces for sending control signals to various actuators or other controllers 132 associated with the cold planer 100. Suitably programmed controller(s) 132 may serve many additional similar or wholly disparate functions as is well-known in the art.

The controller 132 may receive signals or data from an operator interface 138, the leg position sensors 122, the speed sensors 137, the sideplate sensors 140, other controllers 132, and the like. As can be seen in the exemplary embodiment illustrated in FIG. 3, the controller 132 is configured to receive signals from an operator interface 138. The controller may exchange signals or information with another machine controller 132.

In an embodiment, the grade and slope system 142 may receive and process data from the operator interface 138 related to the operator desired grade (depth of the cut), the slope of the cut, a specified cut distance, and the like. The controller 132 may also receive position and/or length data from each leg position sensor 122. As noted, such data may include, but is not limited to, information as to the length L of a leg 118 or the amount of extension or retraction of the leg 118. The controller 132 may also receive data from one or more sideplate sensors 140. Such data may include, but is not limited to, information related to the vertical position of the sideplate 124 and/or whether the sideplate 124 is in contact with the surface 120.

The controller 132 may transmit and receive signals to and from the sensors or machine components. For example, the controller 132 may transmit signals or instructions to increase or decrease the length L of the rear legs 118(*c-d*).

Figure 4:
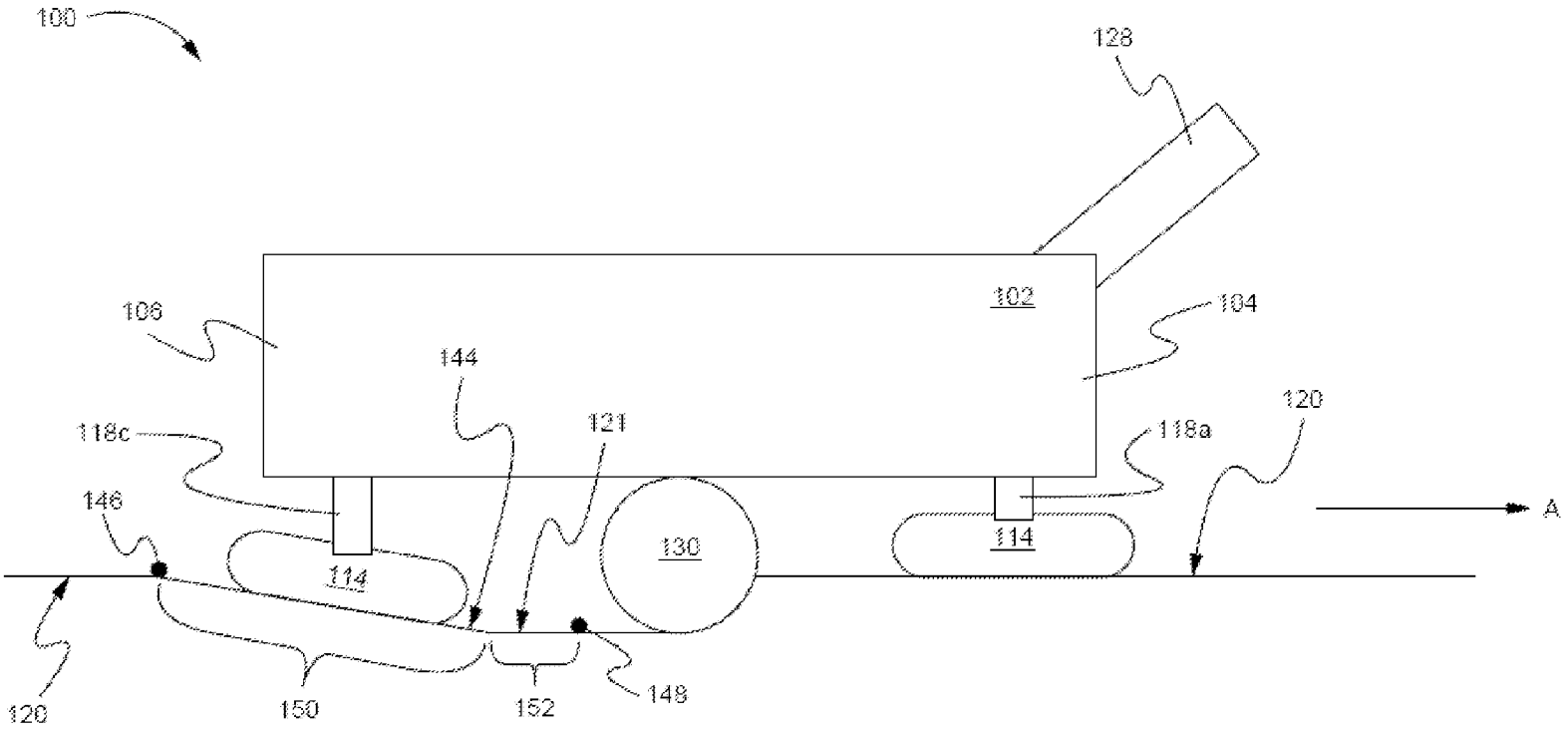
FIG. 4 illustrates an example of leveling a machine on a surface in accordance with a method disclosed herein.
Figure 5:
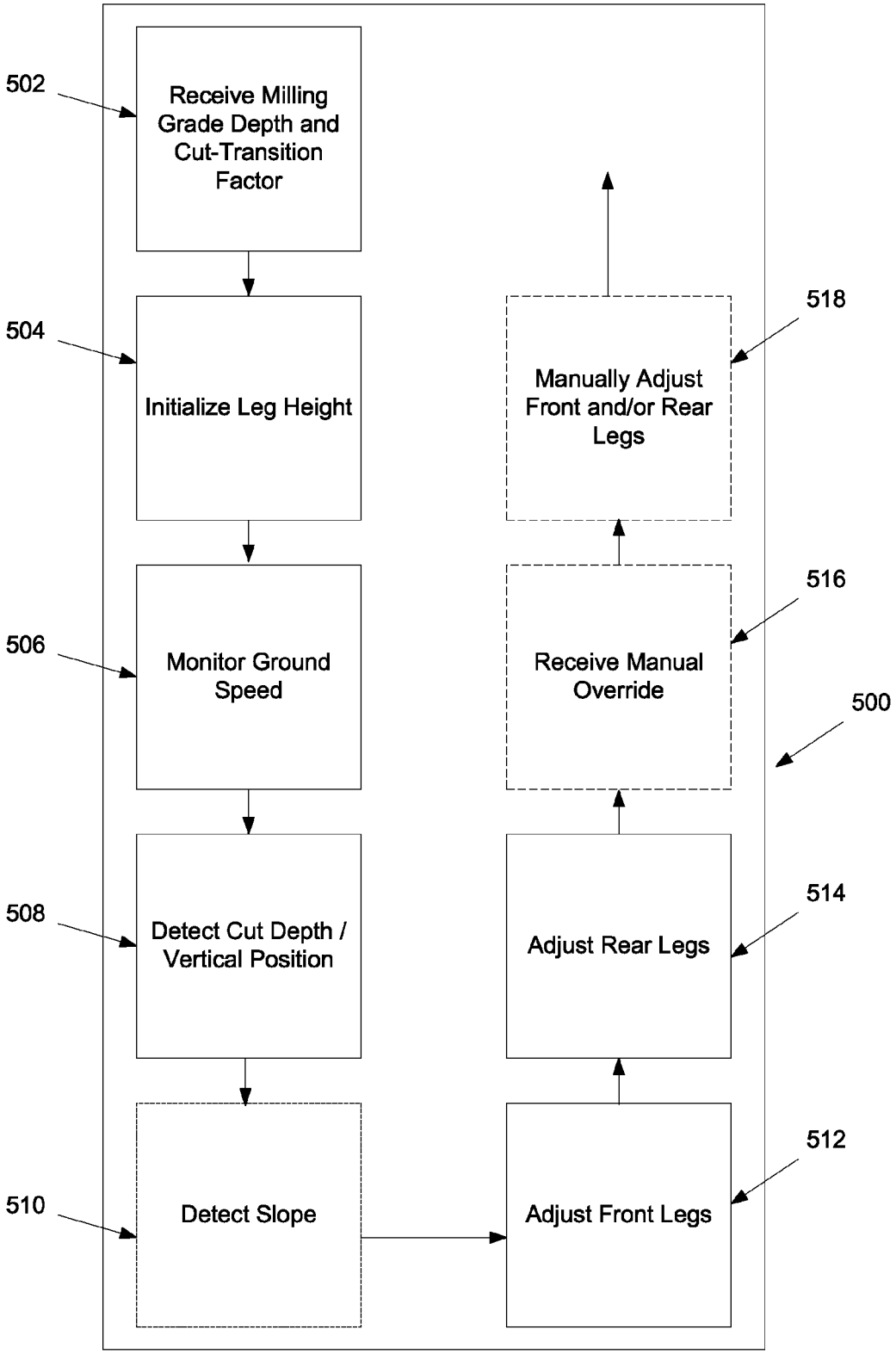
FIG. 5 is a block diagram illustrating a method of cutting a surface disclosed herein.

FIG. 4 illustrates an example of leveling a machine on a surface in accordance with a method disclosed herein. FIG. 5 is a block diagram illustrating a method of cutting a surface disclose herein.

As illustrated in FIG. 4, the travel path 144 for the rear legs (c-d) may comprise the second surface 121 and may include a first point 146 on the second surface 121 and a second point 148 on the second surface 121. The first point 146 (on the second surface 121) may be directly adjacent to the end of first surface 120.

According to embodiments herein, the user interface 138 may receive a target grade (e.g., the grade of the second portion 152). The user interface may also receive a cut-transition factor. The cut-transition factor may be a distance (e.g., the distance or length of the first portion 150), or it may be the slope of the cut-transition (e.g., the slope of the first portion 150 relative to the first surface 120). The slope of the cut-transition and the length of the cut-transition may be mathematically derived from one another, and thus the controller 132 may be configured to receive either value for determining the cut-transition.

During a cut into the first surface 120, cold planer 100 retracts the front and rear legs 118 while maintaining the frame 102 and the drum 130 in a parallel position with the first surface 120. Retraction of the front and rear legs lowers the activated cutting tool 116 into the first surface 120. Scratch is calibrated at the point at which that the drum 130 (including drum bits 131 or the lowest point of a tool 116) touch or scratch the first surface 120. The frame 102 of the cold planer 100 should be parallel to the surface 120 when scratch is calibrated. The term "scratch length" as used herein with regard to a leg 118 means the length of such leg 118 at scratch.

When the drum 130 is activated, rotates and makes cutting contact with a section of the surface 120, material is removed by the drum 130 from that section of the first surface 120. Removal of material from this section of the first surface 120 creates a second surface 121 at a different (and vertically deeper) grade than that of the grade of the first surface 120. Put a different way, the second surface 121 is created by the tool 116 removing the section of the first surface 120.

For explanation purposes herein, the first surface will be considered to have a flat surface with a grade of zero. An absolute value will be used for the measurement value of the grade of a surface that is vertically deeper or below the first surface 120. In other words, a second surface 121 that has a grade of two units below the grade of the first surface 120, will have a grade of 2 units, not a grade of negative 2 units as might be expected using the perspective of a conventional four quadrant x-y coordinate axis. As such, a surface (for example a second surface 121) with a deeper (larger) vertical grade (value) than another surface (for example a first surface 120), will be considered herein to have a greater grade than that of the surface lying in a plane above it.

During such cut, the parallel position of the frame 102 with respect to the first surface 120 may be monitored by the controllers 132. To monitor the parallel position the first controller 132*a* may receive data from the respective position sensors 122 regarding the length (L) of the front and rear legs 118(*a-d*). If the lengths (L) of front and rear legs 118(*a-d*) on the same side (first side 108 or second side 110) of the frame 102 are not substantially the same, the grade and slope system 142 may send a signal to the machine controller 132*b* to adjust the front 118*a*, 118*b* or the rear legs 118*c*, 118*d* in order to maintain the frame 102 parallel with the first surface 120.

After the initial cut is made, the cold planer 100 may move in a forward direction A on the first surface 120. As illustrated in FIG. 4, an initial cut has been made and the cold planer 100 has moved forward in the direction A. The drum 130 continues to rotate and to remove a section of the first surface 120 to create the second surface. Initially both the front and rear legs 118 (*a-d*) move forward in direction A on the first surface 120. However, at some point, the rear legs 118(*c-d*) will begin to descend into the cut and begin to travel over the second surface 121. If no adjustment is made to the length of the rear legs 118(*c-d*), the frame 102 will cease to be substantially parallel with the first surface 120.

The controller 132 is configured to determine the appropriate extension or retraction adjustment to be made to the length of the rear legs 118 (*c-d*) to maintain the frame 102 substantially parallel with respect to the first surface 120 during travel of the rear legs 118 (*c-d*) along the second surface 121.

A first portion 150 of the travel path 144 over the second surface 121 may have a generally linear slope and may contain the first point 146 of the travel path 144. The second portion 152 of the travel path 144 over the second surface 121 may contain the second point 148 and may be substantially linear in shape and lie in a plane that is substantially parallel to the plane of the first surface 120. For clarity of discussion, the initial surface will be referred to as the first surface 120 having a first grade of zero. The second portion 152 of the travel path 144 on the second surface 121 will have a second grade, the second grade may be different from the first grade. The first portion 150 of the travel path on the second surface 121 will have a changing grade as the cut depth is gradually adjusted from the grade of the first surface 120 to the grade of the second portion 152 of the second surface 121.

In the embodiment illustrated in FIG. 4, the second point 148 is the point on the travel path 144 on the second surface 121 at which the length L of each rear leg 118(*c-d*) is substantially the same as the scratch length.

FIG. 5 is a block diagram illustrating a method 500 of cutting a surface (milling) as disclosed herein. The method may be practiced with more or less than the number of steps shown and is not limited to the order shown.

The milling method 500 includes: a Receiving Milling Grade Depth and Cut-Transition Factor Step 502, an Initializing Leg Height step 504, a Monitor Ground Speed step 506, a Detect Cut Depth/Vertical Position step 508, a Detect Slope step 510, an optional Adjust Front Legs step 512, an Adjust Rear Legs step 514, an optional Receive Manual Override step 516, and an optional Manually Adjust Legs step 518.

During step 502 the user input is received from the user interface 138. For instance, the milling grade depth and a cut-transition factor may be received. As discussed, the cut-transition factor may be a transition slope or a transition distance. In other words, the controller 132 may receive from the operator interface 138 the desired final grade of the second surface 121 and the desired distance that the cold planer 100 should travel (the first portion 150 of the second surface 121) to ease into (or out of) a cut to reach the new grade.

During step 504, the initial heights for the rear and front legs 118 may be adjusted. The controller 132 may utilize the following parameters to determine the appropriate height of the legs: the desired grade, the travel distance to ease into (or out of) the cut until the desired grade is achieved, the geometric parameters of the tool such as circumference and radius of the drum, the length of the ground engaging unit, dimensions related to the position and arrangement of the rear leg with respect to the ground engaging unit, and the like. The controller 132 may receive at least some of the parameters for a travel path calculation from the operator interface 138, and a database 134 or other memory accessible by the controller 132.

In step 506, the ground speed is monitored. The ground speed may be measured by the ground speed sensor 137. The distance traveled by the rear legs 118(*c-d*) may be calculated, as is known how to do in the art, using the average measured ground speed from the motor speed sensor 137 and the elapsed time.

In step 508, the cut depth is detected. The cut depth may be determined according to the sideplates sensors 140, sonic sensors, an averaging ski, and/or the leg position sensors 122.

In (optional) step 510, the slope may be determined from a separate slope sensor on the machine. The controller 132 may determine a height adjustment to the legs 118 according to the slope for keeping the mill 130 parallel to the surface 120.

In step 512 and 514, the front legs 118 (*a-b*) and the rear legs 118(*c-d*) may be adjusted. According to embodiments herein, the milling depth of the rotatable drum 130, may be adjusted by adjusting either or both of the front legs 118 (*a-b*) and the rear legs 118(*c-d*).

For example, when the milling depth of the rotatable drum 130 is adjusted via the front legs 118 (*a-b*), the controller 132 determines the change in length L necessary for each front leg 118 (*a-b*) per unit of travel time as the front legs 118 (*a-b*) travel forward on the travel path 144. The distance traveled by the front legs 118(*a-b*) may be calculated, as is known how to do in the art, using the average measured ground speed from the motor speed sensor 137 and the elapsed time.

Similarly, when the milling depth of the rotatable drum 130 is adjusted via the rear legs 118 (*c-d*), the controller 132 determines the change in length L necessary for each rear leg 118(*c-d*) per unit of travel time as the rear legs (118*c-d*) travel forward on the travel path 144. The distance traveled by the rear legs 118(*c-d*) may be calculated, as is known how to do in the art, using the average measured ground speed from the motor speed sensor 137 and the elapsed time.

The controller 132 may generate a cut-transition map to accommodate automatically easing into or out of a cut. The controller 132 may generate a cut-transition map indicating intermediate milling depths at various horizontal distances from a starting position. The controller 132 may generate a transition distance according to the cut-transition factor or the cut-transition factor and the milling grade depth. For instance, if the cut-transition factor is a descent distance, the transition distance may be equal to the cut-transition factor. If the cut-transition factor is a request slope of the transition cut, then the transition distance may be geometrically computed from the depth of the cut and the requested slope.

The controller may then monitor the ground speed (e.g., the ground speed monitored in step 506) of the milling machine 100, and may generate a current horizontal position according to the ground speed (e.g., using the average measured ground speed from the motor speed sensor 137 and the elapsed time). The controller may then adjust a current milling grade depth according to the cut-transition map and the current horizontal position. The controller may adjust the current milling grade depth by adjusting either the front or rear legs 118 according to the cut-transition map and the current horizontal position.

Additionally, the controller 132 may optionally determine the change in length L necessary for leg(s) 118 order to level the machine 100 to the surface 120 (e.g., the un-milled surface 120), in accordance with the vertical position (slope) detected by the sideplate sensors 140. Thus, in steps 512 and 514, the front legs 118 (*a-b*) and/or the rear legs may be automatically adjusted in order to level the machine 100 to the surface 120.

In optional step 516, a manual override may be received from the user interface 138. In the optional step 518, if the manual override is received in step 516, then the controller may allow the manual adjustment of the legs 118.

The controller 132 may continuously receive, or periodically receive the sensor outputs. Thus, the controller 132 may continue to monitor the ground speed (step 506), the cut depth or leg height (step 508), the vertical position (step 510), and continuously adjust the front and rear legs 118 accordingly for the duration of the cut-transition factor (e.g., until the cut-transition distance or depth has been reached).

INDUSTRIAL APPLICABILITY

The present disclosure may find applicability in decreasing or eliminating abrupt changes in the height of the surface 120 which occur when a milling machine 100 initiates a milling cut to a determined depth. According to the present disclosures the machine 100 provides for gradually tapering the milling depth over a determined distance or grade and provides feedback sensors 122, 137, 140 to monitor and assist in the adjustments.

Although certain embodiments have been illustrated and described herein for purposes of description, it will be appreciated by those of ordinary skill in the art that a wide variety of alternate and/or equivalent embodiments or implementations calculated to achieve the same purposes may be substituted for the embodiments shown and described without departing from the scope of the present disclosure. Those with skill in the art will readily appreciate that embodiments in accordance with the present invention may be implemented in a very wide variety of ways. This application is intended to cover any adaptations or variations of the embodiments discussed herein. Therefore, it is intended that embodiments in accordance with the present invention be limited only by the claims and the equivalents thereof.

What is claimed is:

1. A milling machine comprising:

a frame;

a plurality of ground engaging units:

a plurality of vertically adjustable legs, each of the plurality of vertically adjustable legs connecting one of the plurality of ground engaging units to the frame, the plurality of vertically adjustable legs comprising a front leg and a rear leg;

a rotatable mill configured to mill a surface;

a user interface configured to receive a milling grade depth and a cut-transition factor:

a speed sensor configured to provide a ground speed of the milling machine;

a first sideplate disposed on a first side of the milling machine and a second sideplate disposed on a second side of the milling machine;

sideplate sensors disposed on each sideplate, the sideplate sensors configured to provide vertical position information with respect to its respective sideplate;

a vertical position sensor configured to provide a height of the rotatable mill; and a controller coupled to the speed sensor, the vertical position sensor, the sideplate sensors and the user interface, the controller configured to adjust the height of the rotatable mill from a current height to the milling grade depth by incrementally adjusting a length of at least one of the plurality of vertically adjustable legs according to the cut-transition factor, the speed sensor, the sideplate sensors, and the vertical position sensor.

2. The milling machine of claim 1, further comprising a plurality of height sensors, each of the plurality of height sensors configured to provide a height of a respective one of the plurality of vertically adjustable legs, and wherein the controller is further configured to maintain parallel alignment of the rotatable mill to the surface according to the plurality of height sensors and distance traveled.

3. The milling machine of claim 1, wherein the cut-transition factor comprises one of a transition slope or a transition distance.

4. The milling machine of claim 1, wherein the controller is further configured to linearly reduce the height of the rotatable mill from the current height to the milling grade depth across the cut-transition factor.

5. A milling machine of claim 1, wherein the controller is further configured to adjust the length of the front leg to adjust the height of the rotatable mill.

6. A milling machine of claim 1, wherein the controller is further configured to adjust the length of the rear leg to adjust the height of the rotatable mill.

7. A milling machine of claim 6, wherein the controller is further configured to:

receive a manual override signal; and adjust the rear leg or the front leg according to the manual override signal.

8. The milling machine of claim 1, wherein the controller is further configured to generate a transition map according to the cut-transition factor and the milling grade depth, wherein the transition map comprises intermediate milling grade depths and respective horizontal positions.

9. The milling machine of claim 8, wherein the intermediate milling grade depths and the respective horizontal positions are linearly distributed to reduce the height of the rotatable mill from the current height to milling grade depth across the cut-transition factor.

10. A milling machine of claim 1, further comprising a plurality of height sensors, each of the plurality of height sensors configured to provide a height of a respective one of the plurality of vertically adjustable legs, and wherein the controller is further configured to:

continuously monitor the height of the plurality of vertically adjustable legs of the milling machine through respective ones of the plurality of height sensors;

continuously monitor a vertical position through the vertical position sensor;

incrementally adjust the length of the front leg to adjust the height of the rotatable mill according to the cut-transition factor, the speed sensor, and the vertical position sensor; and continuously adjust the rear leg of the milling machine according to the height of the front leg and the slope of the surface.

11. A milling method comprising:

receiving a milling grade depth;

receiving a cut-transition factor;

monitoring a height of a rotatable mill;

monitoring a slope of a machine using sideplate sensors;

monitoring a ground speed of the machine; and automatically adjusting the height of the rotatable mill from a current height to the milling grade depth by incrementally adjusting a length of at least one of a plurality of vertically adjustable legs according to the cut-transition factor, the ground speed of the machine, the slope of the machine, and the height of the rotatable mill.

12. The milling method of claim 11, wherein automatically adjusting the height of the rotatable mill comprises:

determining a cut-transition distance according to the cut-transition factor; and linearly reducing the current height to the milling grade depth across the cut-transition distance.

13. The milling method of claim 12, wherein linearly reducing the current height comprises linearly reducing a height of a front leg of the milling machine.

14. The milling method of claim 12, wherein linearly reducing the current height comprises linearly reducing a height of a rear leg of the milling machine.

15. The milling method of claim 11, wherein automatically adjusting the height of the rotatable mill comprises:

determining a cut-transition distance according to the cut-transition factor; and linearly increasing the current height to the milling grade depth across the cut-transition distance.

16. The milling method of claim 15, wherein linearly increasing the current milling depth comprises linearly increasing the height of a front leg of the milling machine.

17. The milling method of claim 11, further comprising:

continuously monitoring a height of a front leg and a rear leg of the machine;

monitoring a slope of a first surface; and determining a height adjustment to the front leg or the rear leg to level the milling machine to the slope of the first surface according to the monitored slope of the first surface, the height of the front leg, and the height of the rear leg.

18. A milling method of claim 11, further comprising:

receiving a manual override; and adjusting the current milling depth according to the manual override.

19. A milling method comprising:

receiving a milling grade depth;

receiving a cut-transition factor;

generating a transition distance according to the cut-transition factor:

generating a cut-transition map indicating intermediate milling depths and respective horizontal positions;

monitoring a ground speed;

monitoring a vertical position via sideplate sensors;

generating a current horizontal position according to the ground speed: and adjusting a current height of a rotatable mill to the milling grade depth according to the cut-transition map, the vertical position, and the current horizontal position.

20. A milling method of claim 19, wherein generating a cut-transition map comprises generating the intermediate milling depths and the respective horizontal positions such that the intermediate milling depths are successively reduced linearly across the transition distance, and wherein adjusting the current milling depth comprises adjusting a height of a leg of a milling machine according to the cut-transition map and the current horizontal position.

* * * * *